US009102903B2

(12) United States Patent
Reinhardt et al.

(10) Patent No.: US 9,102,903 B2
(45) Date of Patent: Aug. 11, 2015

(54) USE OF TRANSITION METAL COMPLEXES AS BLEACH CATALYSTS IN WASHING AND CLEANING COMPOSITIONS

(75) Inventors: Gerd Reinhardt, Kelkheim (DE); Werner Janitschek, Heistenbach (DE); Miriam Ladwig, Dietzenbach (DE)

(73) Assignee: WEYLCHEM SWITZERLAND AG, Muttenz (CH)

( * ) Notice: Subject to any disclaimer, the term of this patent is extended or adjusted under 35 U.S.C. 154(b) by 120 days.

(21) Appl. No.: 13/982,975

(22) PCT Filed: Feb. 3, 2012

(86) PCT No.: PCT/EP2012/000491

§ 371 (c)(1), (2), (4) Date: Sep. 18, 2013

(87) PCT Pub. No.: WO2012/107187

PCT Pub. Date: Aug. 16, 2012

(65) Prior Publication Data

US 2014/0005091 A1 Jan. 2, 2014

(30) Foreign Application Priority Data

Feb. 10, 2011 (DE) ..... 10 2011 010 818

(51) Int. Cl.

| | |
|---|---|
| ***C11D 3/39*** | (2006.01) |
| ***C11D 3/395*** | (2006.01) |
| ***C11D 7/18*** | (2006.01) |
| ***C11D 7/38*** | (2006.01) |
| ***C11D 3/386*** | (2006.01) |
| ***C11D 1/00*** | (2006.01) |
| ***C11D 7/32*** | (2006.01) |
| ***C11D 3/43*** | (2006.01) |

(52) U.S. Cl.

CPC ..... *C11D 3/3951* (2013.01); *C11D 1/00* (2013.01); *C11D 3/386* (2013.01); *C11D 3/391* (2013.01); *C11D 3/392* (2013.01); *C11D 3/3905* (2013.01); *C11D 3/3932* (2013.01); *C11D 3/43* (2013.01); *C11D 7/32* (2013.01)

(58) Field of Classification Search

CPC ..... C11D 1/00; C11D 3/3905; C11D 3/391; C11D 3/392; C11D 3/43; C11D 3/386; C11D 7/32; B01J 27/24; B01J 23/34; B01J 23/745

USPC ..... 510/224, 226, 310, 311, 312, 313, 372, 510/376, 378, 500; 502/200, 324, 325

See application file for complete search history.

(56) References Cited

U.S. PATENT DOCUMENTS

| | | | |
|---|---|---|---|
| 5,318,733 | A | 6/1994 | Carduck et al. |
| 5,356,607 | A | 10/1994 | Just |
| 5,494,488 | A | 2/1996 | Arnoldi et al. |
| 5,541,316 | A | 7/1996 | Engelskirchen et al. |
| 5,616,550 | A | 4/1997 | Kruse et al. |
| 5,783,616 | A | 7/1998 | Krause et al. |
| 5,830,956 | A | 11/1998 | Stockhausen et al. |
| 2011/0143925 | A1 | 6/2011 | Busch et al. |

FOREIGN PATENT DOCUMENTS

| | | | |
|---|---|---|---|
| DE | 2412837 | A1 | 10/1974 |
| DE | 4221381 | C1 | 2/1994 |
| DE | 4300772 | A1 | 7/1994 |
| DE | 4303320 | A1 | 8/1994 |
| DE | 4417734 | A1 | 11/1995 |
| EP | 0164514 | A1 | 12/1985 |
| EP | 0232202 | A2 | 1/1987 |
| EP | 0237111 | A2 | 9/1987 |
| EP | 0272030 | A2 | 6/1988 |
| EP | 0306089 | A2 | 3/1989 |
| EP | 0392592 | A2 | 10/1990 |
| EP | 0425427 | A2 | 5/1991 |
| EP | 0439387 | A2 | 7/1991 |
| EP | 0443651 | A2 | 8/1991 |
| EP | 0458397 | A2 | 11/1991 |
| EP | 0458398 | A2 | 11/1991 |
| EP | 0544519 | A2 | 6/1993 |
| WO | 9102047 | A1 | 2/1991 |
| WO | 9108171 | A1 | 6/1991 |
| WO | 9218542 | A1 | 10/1992 |
| WO | 9316110 | A1 | 8/1993 |
| WO | 9323523 | A1 | 11/1993 |
| WO | 9839098 | A1 | 9/1998 |
| WO | 9839335 | A1 | 9/1998 |
| WO | 0012808 | A1 | 3/2000 |
| WO | 0148298 | A1 | 7/2001 |

OTHER PUBLICATIONS

W. Kaim and B. Schwederski, "Non-innocent ligands in bioinorganic chemistry", Coordination Chemistry Reviews, 254 (2010), 1580-1588.

C.G. Pierpont, "Studies on charge distribution and valence tautomerism in transition metal complexes of catecholate and semiquinonate ligands", Coordination Chemistry Reviews, 216-217 (2001), 99-125.

J.S. Miller and K.S. Min, "Oxidation Leading to Reduction: Redox-Induced Electron Transfer (RIET)", Angew. Chem. Int. Ed., 48 (2009), 262-272.

C. Carbonera et al., "Thermally and Light-Induced Valence-Tautomeric Transition in Dinuclear Cobalt-Tetraoxolene Complex", Angew. Chem. Int. Ed., 43 (2004), 3135-3138.

(Continued)

*Primary Examiner* — Gregory R Delcotto

(74) *Attorney, Agent, or Firm* — Michael W. Ferrell

(57) ABSTRACT

The invention relates to the use of manganese or iron complexes which, as well as a tetraoxolene unit, contain two macrocyclic, N-containing ligands, especially cyclen or cyclam ligands, in washing and cleaning compositions in the form of granules or powder or solution or suspension for bleaching of colored stains both on textiles and on hard surfaces. The invention also relates to washing and cleaning compositions which comprise such complexes as bleach activators and to the use thereof for textile washing or for dishwashing detergents and other uses in personal care and other areas.

17 Claims, No Drawings

(56) References Cited

OTHER PUBLICATIONS

J. Kotek et al., "Crystal Structures and Reactivity of 3a,5a,8a,10a-Tetraazaperhydropyrene Derivatives. An Alternative Approach to Selective Nitrogen Alkylation of 1,4,8,11-Tetraazacyclotetradecane (Cyclam)", Collect. Czech. Chem. Commun., 65 (2000), 243-266.

R. Tripier et al., "From new tricyclic bisaminal derivatives to trans-N,N'-disubstituted cyclams", Chem. Commun., 2001, 2728-2729.

A. Dei et al., "Tetraoxolene Radical Stabilization by the Interaction with Transition-Metal Ions", Inorg. Chem., 30 (1991), 2589-2594.

D. Guo et al., "Spin Exchange Effects on the Physicochemical Properties of Tetraoxolene-Bridged Bimetallic Complexes", Inorg. Chem., 46 (2007), 3257-3274.

USE OF TRANSITION METAL COMPLEXES AS BLEACH CATALYSTS IN WASHING AND CLEANING COMPOSITIONS

The present invention relates to the use of transition metal complexes which, besides a tetraoxolene unit, contain two macrocyclic, N-containing ligands, in particular cyclen or cyclam ligands, for bleaching colored soilings both on textiles and on hard surfaces. The invention also relates to washing and cleaning compositions which contain such complex compounds.

Inorganic peroxygen compounds, in particular hydrogen peroxide and solid peroxygen compounds, which dissolve in water to liberate hydrogen peroxide, such as sodium perborate and sodium carbonate perhydrate, have been used for a long time as oxidizing agents for disinfection and bleaching purposes. The oxidation effect of these substances is heavily dependent, in dilute solutions, on the temperature; thus, for example, using $H_2O_2$ or perborate in alkaline bleach liquors, a sufficiently rapid bleaching of soiled textiles is achieved only at temperatures above about 80° C.

At lower temperatures, the oxidation effect of the inorganic peroxygen compounds can be improved by adding so-called bleach activators. For this purpose, numerous suggestions have been worked out in the past, especially from the substance classes of N- or O-acyl compounds, for example polyacylated alkylenediamines, in particular tetraacetylglycoluril, N-acylated caprolactams such as benzoylcaprolactam, acetylcaprolactam or nonanoylcaprolactam, hydantoins, hydrazides, triazoles, hydrotriazines, urazoles, diketopiperazines, sulfurylamides and cyanurates, moreover carboxylic anhydrides, in particular phthalic anhydride and substituted maleic anhydrides, carboxylic acid esters, in particular sodium nonanoyloxybenzenesulfonate (NOBS), sodium isononanoyloxybenzene-sulfonate (ISONOBS) and acylated sugar derivatives, such as pentaacetylglucose. By adding these substances it is possible to increase the bleaching action of aqueous peroxide solutions to the extent that even at temperatures around 60° C. essentially the same effects arise as with the peroxide solution on its own at 95° C.

In the course of endeavors to attain environmentally friendly and energy-saving washing and bleaching processes, application temperatures significantly below 60° C., in particular below 45° C., sometimes even down as low as cold-water temperature, have gained in importance in recent years.

At these low temperatures, the effect of the activator compounds known hitherto usually noticeably decreases. There has therefore been no lack of attempts to develop more effective bleach systems for this temperature range although hitherto a really convincing success has not been recorded.

A starting point for this arises from the use of transition metal salts and their complex compounds, as are described for example, in EP 0 237 111, EP 0 272 030, EP 0 306 089, EP 0 392 592 or EP 0 443 651. Furthermore, WO 97/07191 proposes complexes of manganese, iron, cobalt, ruthenium and molybdenum with ligands of the salene type as catalysts for peroxygen compounds in cleaning solutions for hard surfaces.

A multitude of complexes with macrocyclic N-containing ligands has been described in recent years in the literature as bleach catalysts. Thus, EP 0 439 387 claims binuclear metal complexes with ligands obtained by reacting a dialdehyde with primary polyamines as oxygen carrier. EP 0 458 397 and EP 0 458 398 describe the use of manganese complexes with the general form $[L_nMn_mX_p]^zY_q$, where L comprises macrocyclic, N-containing ligands. In particular ligands based on 1,4,7-trimethyl-1,4,7-triazacyclononane ($Me_3TACN$) and derivatives thereof are described. Compounds of the type $[LMn(OR)_3]Y$ are described in EP 0 544 519, where in particular TACN, $Me_3TACN$, 1,5,9-trimethyl-1,5,9-triazacyclodecane in particular are contemplated as ligands therein.

Transition metal complexes with rigid ligands, in particular rigidly bridged N-containing macrocycles with at least 3 donor atoms, of which 2 form a bridgehead, are described in detail in WO 1998/039335 and WO 1998/039098 as oxidation catalysts. Examples of the ligands are 5,12-dimethyl-1,5,8,12-tetraazabicyclo[6.6.2]hexadecane (Bcyclam) and 5-N-octyl-12-methyl-1,5,8,12-tetraazabicyclo[6.6.2]hexadecane.

WO 2001/048298 describes corresponding bridged ligands for bleaching with atmospheric oxygen. Similar metal complexes based on unbridged, macrocyclic ligands are claimed in WO 2000/012808 as "aerial bleaching systems" for use in washing and cleaning compositions.

Metal complexes containing one or more dioxolene or tetraoxolene units are interesting systems since the ligands are "non-innocent" ligands which are able to change their oxidation state in redox reactions. The dioxolene unit used in most cases is (substituted) catecholates or semiquinones. Bioinorganic aspects of "non-innocent" ligands are described, e.g. in W. Kaim and B. Schwerderski, "Non-innocent ligands in bioinorganic chemistry", Coordination Chemistry Reviews, 254 (2010), 1580-1588. An overview of complexes with catecholate and semiquinone ligands is given in C. G. Pierpont, "Studies on charge distribution and valence tautomerism in transition metal complexes of catecholate and semiquinone ligands", Coordination Chemistry Review, 216-217 (2001), 99-125.

Tetraoxolene complexes with a tetraoxolate unit between two transition metals and their redox chemistry are described e.g. in J. S. Miller and K. S. Min, "Oxidation führt zur Reduktion—redoxinduzierter Elektronentransfer (RIET)" ["Oxidation leads to reduction—redox-induced electron transfer (RIET)"], Angew. Chem. 121 (2009), 268-278 or Ch. Carbonera et al., "Thermally and Light-Induced Valence-Tautomeric Transition in Dinuclear Cobalt-Tetraoxolene Complex", Angew. Chem. Int. Ed., 43 (2004), 3136-3138.

Surprisingly, it has now been found that certain transition metal complexes containing catecholate, semiquinone or tetraoxolene ligands can be used in washing and cleaning compositions and have clear advantages as regards the bleaching capacity on colored soilings. They can either be used in those washing and cleaning compositions which comprise hydrogen peroxide and other peroxy compounds (e.g. peroxycarboxylic acids), but also in those which are free from oxidizing agents.

The object of the present invention was to achieve the improvement in the oxidizing and bleaching effect of washing and cleaning compositions at particularly low temperatures below 60° C., in particular in the temperature range from 20° C. to 45° C.

This object is achieved through the use of transition metal complexes of the formula (I)

$$[(L)M(Y)M(L)]X_m \quad (I)$$

where

M is a metal atom from the group Mn and Fe,

L is a ligand of the general formula (II) or (III)

(II)

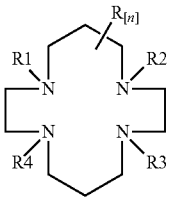

(III)

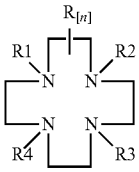

in which

R is a hydrogen or alkyl having 1 to 8 carbon atoms,

R1, R2, R3 and R4 are identical or different and are a hydrogen, alkyl having 1 to 8 carbon atoms, a nitrogen-bridging alkylene unit having 2 to 4 carbon atoms or alkaryl having 6 to 16 carbon atoms, n is an integer from 0 to 6, Y is a group of the formula (IV)

(IV)

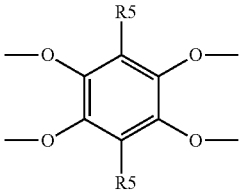

in which

R5 are identical or different and are a hydrogen, alkyl having 1 to 4 carbon atoms, Cl or Br, X is a neutral or anion ligand from the group $CH_3CN$, chloride, bromide, nitrate, perchlorate, sulfate, citrate, hexafluorophosphate, trifluoromethanesulfonate, tetrafluoroborate, tetraphenylborate, or anions of organic acids with $C_1$-$C_{22}$ carbon atoms, or $H_2O$, and m is a number from 0 to 4, as bleach catalyst in washing and cleaning compositions.

Preference is given to using complexes with transition metal central atoms in oxidation states +2, +3, or +4, where complexes with manganese as the central atom are preferred according to the invention. The radicals R and R1 to R4 here are preferably hydrogen or methyl groups, alkylaryl radicals containing 6 to 16 carbon atoms in the alkyl moiety, where phenyl is preferred as aryl.

In the metal-bridging group of the formula (IV), the radicals R5 are preferably hydrogen or chlorine.

Preferred ligands L are:

1,4,7,10-tetraazacyclododecane (cyclen); 1,7-dimethyl-1,4,7,10-tetraazacyclododecane; 1,4,8,11-tetraazacyclotetradecane (cyclam); 1,4,8,11-tetramethyl-1,4,8,11-tetraazacyclotetradecane; 5,7,7,12,14,14-hexamethyl-1,4,8,11-tetraazacyclotetradecane; 1,8-dimethyl-1,4,8,11-tetraazacyclotetradecane; 1,8-diethyl-1,4,8,11-tetraazacyclotetradecane (diethylcyclam); 5,12-dimethyl-1,5,8,12-tetraazabicyclo[6.6.2]hexadecane (dimethyl-Bcyclam), 5,12-diethyl-1,5,8,12-tetraazabicyclo[6.6.2]hexadecane (diethyl-Bcyclam) and 5-N-octyl-12-methyl-1,5,8,12-tetraazabicyclo[6.6.2]hexadecane.

Besides the complexes according to the invention of the unsubstituted or tetrasubstituted cyclams or cyclens of the formula (I), in particular complexes with 2 alkyl or alkaryl radicals on the tetraazacycle with the general structures (V), (VI) and the bridged cyclams (VII) are of particular advantage:

(V)

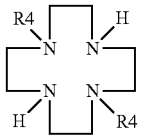

(VI)

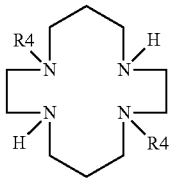

(VII)

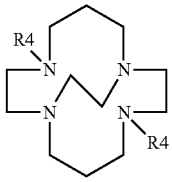

where R4 and R4, independently of one another, are a methyl, ethyl, propyl, butyl or benzyl group.

According to the invention, particular preference is given to complexes with the following ligands: 1,8-dimethylcyclam, 1,7-dimethylcyclen, 1,8-diethylcyclam, 1,7-diethylcyclen, 1,8-dibenzylcyclam and 1,7-dibenzylcyclen.

The ligands (V) and (VI) can be prepared according to J. Kotter et al., Collect. Czech. Chem. Commun., 2000, 65, 243-266, or R. Tripier et al., Chem. Commun., 2001, 2728-2729. Syntheses of ligands of the formula (VII) are described e.g. in WO 1998/039335 and WO 1998/039098.

Syntheses of tetraoxolene transition metal complexes are described inter alia in A. Die et al., "Tetraoxolene Radical Stabilization by Interaction with Transition Metal Ions", Inorg. Chem., 30 (1991), 2590, compounds with non-cyclic ligands are described in D. Guo et al., "Spin Exchange Effects on the Physicochemical Properties of Tetraoxolene-Bridged Bimetallic Complexes", Inorg. Chem., 46 (2007), 3257-3274.

The transition metal complexes of the formula (I) are used in washing and cleaning compositions, in particular in the washing of textiles and in cleaning compositions for hard surfaces, then primarily for dishes and in solutions for bleaching colored soilings. This takes place firstly in the presence of hydrogen peroxide, hydrogen peroxide-releasing compounds or a peroxygen compound. It was surprising, however, that the complexes are also able to be used without a peroxo compound or are activated e.g. by the oxygen in the air.

For the purposes of activating the complexes, peroxygen compounds or atmospheric oxygen are contemplated. A suitable peroxygen compound is primarily hydrogen peroxide, alkali metal perborate mono- or tetrahydrates and/or alkali metal percarbonates, where sodium is the preferred alkali metal. As well as these, however, it is also possible to use alkali metal or ammonium peroxosulfates, such as e.g. potassium peroxomonosulfate (industrially: Caroat® or Oxone®). The concentration of the inorganic oxidizing agents in the overall formulation of the washing and cleaning composition is 2 to 90%, preferably 3 to 60%, particularly preferably 5 to 25%.

Suitable peroxygen compounds are also organic-based oxidizing agents.

These include all known peroxycarboxylic acids, e.g. monoperoxyphthalic acid, peracetic acid, dodecanediperoxy acid, phthalimidoperoxycarboxylic acids such as PAP and related systems or amido peracids.

The use amounts of peroxygen compounds are generally chosen such that between 10 ppm and 10% active oxygen, preferably between 50 ppm and 5000 ppm of active oxygen, are present in the solutions of the washing and cleaning compositions. The amount of bleach-boosting complex compound used also depends on the intended use. Depending on the desired degree of activation, it is used in an amount of from 0.01 mmol to 25 mmol, preferably 0.1 mmol to 2 mmol, of complex per mol of peroxygen compound. However, in special cases it is also possible to exceed or fall short of these limits.

Preferably 0.0025 to 1% by weight, in particular 0.01 to 0.5% by weight, of the bleach-boosting complex compound defined above are present in washing and cleaning compositions.

Besides the iron or manganese complexes according to the invention, hydrogen peroxide and persalts, further bleach catalysts or bleach activators can be used advantageously in combination in order to broaden the spectrum of activity of the bleaching systems used according to the invention and in order to increase the efficiency, in particular as regards the germ-killing effect (disinfection).

In addition to the complex compounds used according to the invention, conventional bleach activators, i.e. compounds which release peroxocarboxylic acids under perhydrolysis conditions, can be used. The customary bleach activators which contain O- and/or N-acyl groups are suitable. Preference is given to polyacylated alkylenediamines, in particular tetraacetylethylenediamine (TAED), acylated glycolurils, in particular tetraacetylglycoluril (TAGU), acylated triazine derivatives, in particular 1,5-diacetyl-2,4-dioxohexahydro-1,3,5-triazine (DADHT), acylated phenylsulfonates, in particular nonanoyl, isononanoyl or lauroyloxybenzenesulfonate (NOBS, ISONOBS and LOBS) or amido derivatives thereof (e.g. NACAOBS), acylated hydroxycarboxylic acids such as acetylsalicylic acid or nonanoyloxybenzoic acid (NOBA) and decanoyloxybenzoic acid (DOBA), acylated polyhydric alcohols, in particular triacetin, ethylene glycol diacetate and 2,5-diacetoxy-2,5-dihydrofuran, and acetylated sorbitol and mannitol, and acetylated sugar derivatives, in particular pentaacetyl glucose (PAG), pentaacetylfructose, tetraacetylxylose and octaacetyllactose, and acetylated optionally N-alkylated glucamine and gluconolactone. Open-chain or cyclic nitrile quats are also suitable for this purpose. The combinations of conventional bleach activators known from DE-A 44 43 177 can also be used. Furthermore, benzoylcaprolactam or acetylcaprolactam can be used. Additionally, combinations of the complexes according to the invention with other metal complexes can also be used. The concentration of the bleach activators in the overall formulation of the washing and cleaning composition is 0.1 to 20% by weight, preferably 0.5 to 10% by weight, particularly preferably 1 to 6% by weight, in each case based on the total weight.

According to the application, the term bleaching involves both the bleaching of soil on the surface of textiles, and also the bleaching of soil detached from the textile surface and present in the wash liquor. Analogous statements apply to the bleaching of soilings on hard surfaces. Further potential uses are in the personal care sector, e.g. for the bleaching of hair and for improving the effectiveness of denture cleaners, in particular even at low temperatures. In addition, the metal complexes described are used in commercial laundries, in the bleaching of wood and paper, the bleaching of cotton and in disinfectants.

Furthermore, the invention relates to a method of cleaning textiles and also of hard surfaces, in particular of dishes, using said complex compounds together with peroxygen compounds in aqueous solution optionally comprising further washing or cleaning composition constituents. The invention also relates to washing compositions and cleaning compositions for hard surfaces, in particular dishwashing compositions, preference being given to those for use in automatic processes which comprise complex compounds of this type.

The use according to the invention essentially consists, in the case of hard surfaces contaminated with colored soilings or in the case of soiled textiles, in providing conditions under which a peroxidic oxidizing agent and the complex compound can react with one another with the aim of obtaining secondary products which have a stronger oxidizing effect. Such conditions prevail particularly when the reactants encounter one another in aqueous solution. This can arise by separately adding the peroxygen compound and the complex to the aqueous solution of the washing and cleaning composition. However, the process according to the invention is particularly advantageously carried out using a washing composition or cleaning composition for hard surfaces which comprises the complex compound and optionally a peroxygen-containing oxidizing agent. The peroxygen compound can also be added to the solution separately without a diluent or, preferably, as an aqueous solution or suspension if a peroxygen-free washing composition or cleaning composition is used.

The washing and cleaning compositions, which can be in the form of granules, pulverulent or tableted solids, of other moldings, homogeneous solutions or suspensions, can in principle comprise all ingredients known and customary in such compositions in addition to said bleach-boosting metal complex. The compositions can, in particular, comprise builder substances, surface-active surfactants, peroxygen compounds, additional peroxygen activators or organic peracids, water-miscible organic solvents, sequestering agents, enzymes, and specific additives with an action which is gentle on colors and fibers. Further auxiliaries, such as electrolytes, pH regulators, silver corrosion inhibitors, foam regulators and dyes and fragrances, are possible.

A hard-surface cleaning composition according to the invention can moreover comprise abrasive constituents, in particular quartz flours, wood flours, plastic flours, chalks and micro glass beads, and mixtures thereof. Abrasive substances are preferably present in the cleaning compositions in amounts not exceeding 20% by weight, in particular from 5 to 15% by weight.

The washing and cleaning compositions can comprise one or more surfactants, suitable surfactants being, in particular, anionic surfactants, nonionic surfactants, and mixtures thereof, and also cationic, zwitterionic and amphoteric surfactants. Such surfactants are present in washing compositions according to the invention in amounts of preferably 1 to 50% by weight, in particular from 3 to 30% by weight, whereas in hard-surface cleaning compositions, lesser amounts, i.e. amounts up to 20% by weight, in particular up to 10% by weight and preferably in the range from 0.5 to 5% by weight, are normally present. In cleaning compositions for use in machine dishwashing processes, low-foam compounds are normally used.

Anionic surfactants suitable according to the invention are, in particular, soaps and those which contain sulfate or sulfonate groups. Suitable surfactants of the sulfonate type are preferably $C_9$-$C_{13}$-alkylbenzenesulfonates, olefinsulfonates, i.e. mixtures of alkene- and hydroxyalkanesulfonates, and disulfonates, as are obtained, for example, from monoolefins with terminal or internal double bond by sulfonation with gaseous sulfur trioxide and subsequent alkaline or acidic hydrolysis of the sulfonation products. Also suitable are alkanesulfonates obtained from $C_{12}$-$C_{18}$-alkanes, for example by sulfochlorination or sulfoxidation with subsequent hydrolysis or neutralization. Also suitable are the esters of alpha-sulfofatty acids (ester sulfonates), for example the alpha-sulfonated methyl esters of hydrogenated coconut, palm kernel or tallow fatty acids which are prepared by sulfonation of the methyl esters of fatty acids of vegetable and/or animal origin having 8 to 20 carbon atoms in the fatty acid molecule, and subsequent neutralization to give water-soluble monosalts.

Further anionic surfactants suitable according to the invention are sulfated fatty acid glycerol esters, which are mono-, di- and triesters, and mixtures thereof. Preferred alk(en)yl sulfates are the alkali metal and, in particular, the sodium salts of sulfuric half-esters of $C_{12}$-$C_{18}$-fatty alcohols, for example from coconut fatty alcohol, tallow fatty alcohol, lauryl, myristyl, cetyl or stearyl alcohol or of $C_8$-$C_{20}$-oxo alcohols and those half-esters of secondary alcohols of this chain length. Also preferred are alk(en)yl sulfates of said chain length which contain a synthetic straight-chain alkyl radical prepared on a petrochemical basis. 2,3-Alkyl sulfates are also suitable anionic surfactants. Also suitable are the sulfuric monoesters of the straight-chain or branched alcohols ethoxylated with 1 to 6 mol of ethylene oxide, such as 2-methyl-branched $C_9$-$C_{11}$-alcohols having, on average, 3.5 mol of ethylene oxide (EO) or $C_{12}$-$C_{18}$-fatty alcohols having 1 to 4 EO.

Preferred anionic surfactants also include the salts of alkylsulfosuccinic acid, which are also referred to as sulfosuccinates or as sulfosuccinic esters and which are monoesters and/or diesters of sulfosuccinic acid with alcohols, preferably with fatty alcohols and, in particular, with ethoxylated fatty alcohols. Preferred sulfosuccinates contain $C_8$-$C_{18}$-fatty alcohol radicals or mixtures thereof. Further suitable anionic surfactants according to the invention are fatty acid derivatives of amino acids, for example of N-methyltaurine (taurides) and/or of N-methylglycine (sarcosinates). Further anionic surfactants contemplated are, in particular, soaps, for example in amounts of from 0.2 to 5% by weight. In particular, saturated fatty acid soaps, such as the salts of lauric acid, myristic acid, palmitic acid, stearic acid, hydrogenated erucic acid and behenic acid, and, in particular, soap mixtures derived from natural fatty acids, for example coconut, palm kernel or tallow fatty acids, are suitable in this connection.

The anionic surfactants, including the soaps, can be present in the form of their sodium, potassium or ammonium salts, and as soluble salts of organic bases, such as mono-, di- or triethanolamine. The anionic surfactants are preferably in the form of their sodium or potassium salts, in particular in the form of the sodium salts. Anionic surfactants are present in washing compositions according to the invention preferably in amounts of from 0.5 to 10% by weight and, in particular, in amounts of from 5 to 25% by weight.

The nonionic surfactants used are preferably alkoxylated, advantageously ethoxylated, in particular primary, alcohols having, preferably, 8 to 18 carbon atoms and, on average, 1 to 12 mol of ethylene oxide (EO) per mole of alcohol, in which the alcohol radical may be linear or, preferably, methyl-branched in the 2-position, or may comprise a mixture of linear and methyl-branched radicals, as are usually present in oxo alcohol radicals. However, particular preference is given to alcohol ethoxylates with linear radicals from alcohols of a native origin having 12 to 18 carbon atoms, e.g. from coconut, palm, tallow fatty or oleyl alcohol, and, on average, 2 to 8 EO per mole of alcohol. Preferred ethoxylated alcohols include, for example, $C_{12}$-$C_{14}$-alcohols having 3 EO or 4 EO, $C_9$-$C_{11}$-alcohols having 7 EO, $C_{13}$-$C_{15}$-alcohols having 3 EO, 5 EO, 7 EO or 8 EO, $C_{12}$-$C_{18}$-alcohols having 3 EO, 5 EO or 7 EO and mixtures thereof, such as mixtures of $C_{12}$-$C_{14}$-alcohol with 3 EO and $C_{12}$-$C_{18}$-alcohol with 7 EO. The degrees of ethoxylation stated above are statistical average values which, for a specific product, may be an integer or a fraction. Preferred alcohol ethoxylates have a narrowed homolog distribution (narrow range ethoxylates, NRE). In addition to these nonionic surfactants, it is also possible to use fatty alcohols having more than 12 EO. Examples thereof are (tallow) fatty alcohols having 14 ED, 16 EO, 20 EO, 25 EO, 30 EO or 40 EO.

The nonionic surfactants also include alkyl glycosides of the formula $RO(G)_x$ in which R is a primary straight-chain or methyl-branched, in particular methyl-branched in the 2-position, aliphatic radical having 8 to 22, preferably 12 to 18, carbon atoms and G is a glycose unit having 5 or 6 carbon atoms, preferably glucose. The degree of oligomerization x, which gives the distribution of monoglycosides and oligoglycosides, is any desired number—which, being an analytically determined parameter, can also assume fractional values—between 1 and 10; x is preferably 1.2 to 1.4. Likewise suitable are polyhydroxyfatty acid amides of the formula (VIII)

(VIII)

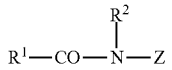

in which the radical $R^1$—CO is an aliphatic acyl radical having 6 to 22 carbon atoms, $R^2$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxyfatty acid amides are preferably derived from reducing sugars having 5 or 6 carbon atoms, in particular from glucose.

The group of polyhydroxyfatty acid amides also includes compounds of the formula (IX)

(IX)

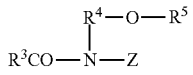

in which $R^3$ is a linear or branched alkyl or alkenyl radical having 7 to 21 carbon atoms, $R^4$ is a linear, branched or cyclic alkylene radical or an arylene radical having 6 to 8 carbon atoms and $R^5$ is a linear, branched or cyclic alkyl radical or an aryl radical or an oxyalkyl radical having 1 to 8 carbon atoms, where $C_1$-$C_4$-alkyl or phenyl radicals are preferred, and Z is a linear polyhydroxyalkyl radical whose alkyl chain is substituted by at least two hydroxyl groups, or alkoxylated, preferably ethoxylated or propoxylated, derivatives of this radical. Z is here, too, preferably obtained by reductive amination of a sugar such as glucose, fructose, maltose, lactose, galactose, mannose or xylose. The N-alkoxy- or —N-aryloxy-substituted compounds can then be converted into the desired polyhydroxyfatty acid amides, for example by reaction with fatty acid methyl esters in the presence of an alkoxide as catalyst.

Within the context of the present invention, a further class of preferred nonionic surfactants, which are used either as the sole nonionic surfactant or in combination with other nonionic surfactants, in particular together with alkoxylated fatty alcohols and/or alkyl glycosides, are alkoxylated, preferably ethoxylated or ethoxylated and propoxylated, fatty acid alkyl esters, preferably having 1 to 4 carbon atoms in the alkyl chain, in particular fatty acid methyl esters.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type may also be suitable according to the invention.

From the large group of cationic surfactants, particular preference is given to hydroxyalkyl quats of the general structures (X) and (XI).

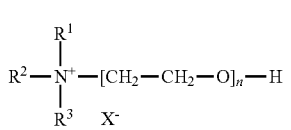

(X)

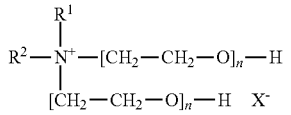

(XI)

where the radicals $R^1$, $R^2$, $R^3$=$C_1$-$C_{22}$-alkyl and n=1 to 5.

Other suitable surfactants are "gemini surfactants". These are generally understood as meaning compounds which have two hydrophilic groups per molecule. These groups are usually separated from one another by a "spacer". This spacer is usually a carbon chain which should be long enough for the hydrophilic groups to have a sufficient distance such that they can act independently of one another. Such surfactants are generally characterized by an unusually low critical micelle concentration and the ability to drastically reduce the surface tension of water. However, it is also possible to use gemini polyhydroxyfatty acid amides or poly-polyhydroxyfatty acid amides. Further surfactant types can have dendrimeric structures.

A washing composition according to the invention preferably comprises at least one water-soluble and/or water-insoluble, organic and/or inorganic builder.

Suitable water-soluble inorganic builder materials are, in particular, alkali metal silicates and polymeric alkali metal phosphates, which can be in the form of their alkaline, neutral or acidic sodium or potassium salts. Examples thereof are trisodium phosphate, tetrasodium diphosphate, disodium dihydrogen diphosphate, pentasodium triphosphate, "sodium hexametaphosphate", and the corresponding potassium salts, or mixtures of sodium and potassium salts. Suitable water-insoluble, water-dispersible inorganic builder materials used are, in particular, crystalline or amorphous alkali metal alumosilicates, in amounts of up to 50% by weight. Of these, the crystalline sodium alumosilicates in washing composition quality, in particular zeolite A, P and optionally X, alone or in mixtures, for example in the form of a cocrystallisate of the zeolites A and X, are preferred. Their calcium-binding capacity, which can be determined in accordance with the details in German patent specification DE 24 12 837, is usually in the range from 100 to 200 mg of CaO per gram. Suitable builder substances are also crystalline alkali metal silicates, which can be present alone or as a mixture with amorphous silicates. The alkali metal silicates which can be used as builders preferably have a molar ratio of alkali metal oxide to $SiO_2$ below 0.95, in particular of 1:1.1 to 1:12 and can be in amorphous or crystalline form. Preferred alkali metal silicates are the sodium silicates, in particular the amorphous sodium silicates having a molar ratio of $Na_2O$:SiO of 1:2 to 1:2.8. Such silicates can be prepared by the process in the European patent application EP 0 425 427. The crystalline silicates used, which can be present alone or as a mixture with amorphous silicates, are preferably crystalline phyllosilicates of the formula $Na_2Si_xO_{2x+1}.y\ H_2O$, in which x, the "modulus", is a number from 1.9 to 4 and y is a number from 0 to 20, and preferred values for x are 2, 3 or 4. Crystalline phyllosilicates which fall under this general formula are described, for example, in the European patent application EP 0 164 514. Preferred crystalline phyllosilicates are those in which x in said formula assumes the values 2 or 3. Particular preference is given to both δ- and β-sodium disilicates ($Na_2Si_2O_5.y\ H_2O$), where β-sodium disilicate can be obtained, for example, by the process which is described in WO 91/08171. β-Sodium silicates with a modulus between 1.9 and 3.2 can be prepared in accordance with Japanese patent applications JP 04/238 809 or JP 04/260 610. Virtually anhydrous crystalline alkali metal silicates prepared from amorphous silicates and of the abovementioned formula in which x is a number from 1.9 to 2.1, can also be used. In a further preferred embodiment of such compositions, a crystalline sodium phyllosilicate with a modulus of from 2 to 3 is used. Crystalline sodium silicates with a modulus in the range from 1.9 to 3.5, are used in a further preferred embodiment. In a preferred embodiment, a granular compound of alkali metal silicate and alkali metal carbonate, as is commercially available, for example, under the name Nabion®, is used. In cases where alkali metal alumosilicate, in particular zeolite, is present as additional builder substance, the weight ratio of alumosilicate to silicate, in each case based on anhydrous active substances, is preferably 1:10 to 10:1. In compositions which comprise both amorphous and crystalline alkali metal silicates, the weight ratio of amorphous alkali metal silicate to crystalline alkali metal silicate is preferably 1:2 to 2:1 and in particular 1:1 to 2:1.

Such builder substances are present in washing and cleaning compositions according to the invention preferably in amounts up to at most 60% by weight, preferably in the range from 5 to 40% by weight, based on the total weight of the washing and cleaning composition.

The water-soluble organic builder substances include polycarboxylic acids, in particular citric acid and sugar acids, aminopolycarboxylic acids, in particular methylglycinediacetic acid, nitrilotriacetic acid and ethylenediaminetetraacetic acid, and polyaspartic acid.

Polyphosphonic acids, in particular aminotris(methylenephosphonic acid), ethylenediaminetetrakis(methylenephosphonic acid) and 1-hydroxyethane-1,1-diphosphonic acid, can likewise be used. Preference is also given to polymeric (poly)carboxylic acids, in particular the polycarboxylates accessible by oxidation of polysaccharides or dextrins of the international patent application WO 93/16110 or of the international patent application WO 92/18542 or of the European patent specification EP 0 232 202, polymeric acrylic acids, methacrylic acids, maleic acids and mixed polymers thereof, which may also comprise small amounts of polymerizable substances without carboxylic acid functionality in copolymerized form. According to manufacturer's information, the average molecular mass of the homopolymers of unsaturated carboxylic acids, expressed as $M_w$ is generally between 5000 and 200 000, that of the copolymers is between 2000 and 200 000, preferably 50 000 to 120 000, in each case based on free acid. A particularly preferred acrylic acid-maleic acid copolymer has an average molar mass of from 50 000 to 100 000. Commercially available products are, for example, Sokalan® CP 5, CP 10 and PA 30 from BASF. Also suitable are copolymers of acrylic acid or methacrylic acid with vinyl ethers, such as vinyl methyl ethers, vinyl esters, ethylene, propylene and styrene, in which the proportion of acid is at least 50% by weight. Other water-soluble organic builder substances which may be used are terpolymers which contain, as monomers, two unsaturated acids and/or salts thereof, and, as a third monomer, vinyl alcohol and/or an esterified vinyl alcohol or a carbohydrate. The first acidic monomer or salt thereof is derived from a monoethylenically unsaturated $C_3$-$C_8$-carboxylic acid, preferably from a $C_3$-$C_4$-monocarboxylic acid, in particular from (meth)acrylic acid, where the second acidic monomer or salt thereof can be a derivative of a $C_4$-$C_8$-dicarboxylic acid, maleic acid being particularly preferred, and/or a derivative of an allylsulfonic acid which is substituted in the 2-position by an alkyl or aryl radical. Such polymers can be prepared in particular in accordance with processes which are described in the German patent specifications DE 42 21 381 and DE 43 00 772, and generally have a relative molecular mass between 1000 and 200 000. Further preferred copolymers are those which are described in the German patent applications DE 43 03 320 and DE 44 17 734 and have, as monomers, preferably acrolein and acrylic acid/acrylic acid salts or vinyl acetate.

The organic builder substances can, in particular for the preparation of liquid compositions, be used in the form of aqueous solutions, preferably in the form of 30 to 50% strength by weight aqueous solutions. All said acids are usually used in the form of their water-soluble salts, in particular their alkali metal salts.

Such organic builder substances can, if desired, be present in amounts up to 40% by weight, in particular up to 25% by weight and preferably from 1 to 8% by weight. Amounts close to said upper limit are preferably used in pasty or liquid, in particular water-containing, compositions.

Suitable water-soluble builder components in hard-surface cleaning compositions according to the invention are, in principle, all builders customarily used in compositions for machine dishwashing, for example the abovementioned alkali metal phosphates. Their amounts can be in the range up to about 60% by weight, in particular 5 to 20% by weight, based on the overall composition. Further possible water-soluble builder components are, as well as polyphosphonates and phosphonate alkyl carboxylates, for example organic polymers of native or synthetic origin of the polycarboxylate type listed above which, particularly in hard-water regions, act as cobuilders, and naturally occurring hydroxycarboxylic acids, such as, for example, mono-, dihydroxysuccinic acid, alpha-hydroxypropionic acid and gluconic acid. Preferred organic builder components include the salts of citric acid, in particular sodium citrate. Suitable as sodium citrate are anhydrous trisodium citrate and, preferably, trisodium citrate dihydrate. Trisodium citrate dihydrate can be used as a finely or coarsely crystalline powder. Depending on the pH ultimately set in the cleaning compositions according to the invention, the acids corresponding to said cobuilder salts may also be present.

The enzymes optionally present in the compositions according to the invention include proteases, amylases, pullulanases, cellulases, cutinases and/or lipases, for example proteases such as BLAP®, Optimase®, Opticlean®, Maxacal®, Maxapem®, Durazym®, Purafect® OxP, Esperase® and/or Savinase®, amylases such as Termamyl®, amylase-LT, Maxamyl®, Duramyl®, Purafectel OxAm, cellulases such as Celluzyme®, Carezyme®, K-AC® and/or the cellulases known from international patent applications WO 96/34108 and WO 96/34092 and/or lipases, such as Lipolase®, Lipomax®, Lumafast® and/or Lipozym®. The enzymes used can, as described, for example, in international patent applications WO 92/111347 or WO 94/23005, be adsorbed to carrier substances and/or embedded in coating substances in order to protect them from premature deactivation. They are present in washing and cleaning compositions according to the invention preferably in amounts of up to 10% by weight, in particular from 0.05 to 5% by weight, particular preference being given to using enzymes stabilized against oxidative degradation.

Machine dishwashing compositions according to the invention preferably comprise the customary alkali metal carriers, such as, for example, alkali metal silicates, alkali metal carbonates and/or alkali metal hydrogencarbonates. The customarily used alkali metal carriers include carbonates, hydrogencarbonates and alkali metal silicates with an $SiO_2/M_2O$ molar ratio (M=alkali metal atom) of from 1:1 to 2.5:1. Alkali metal silicates can be present in amounts of up to 40% by weight, in particular 3 to 30% by weight, based on the overall composition. The alkali metal carrier system very preferably used in cleaning compositions according to the invention is a mixture of carbonate and hydrogencarbonate, preferably sodium carbonate and sodium hydrogencarbonate, which may be present in an amount of up to 50% by weight, preferably 5 to 40% by weight.

The invention further provides a composition for machine dishwashing, comprising 15 to 65% by weight, in particular 20 to 60% by weight, of water-soluble builder component, 5 to 25% by weight, in particular 8 to 17% by weight, of oxygen-based bleaches, in each case based on the overall composition, and 0.1 to 1% by weight of one or more of the above-defined metal complexes. Such a composition preferably has low alkalinity, i.e. its solution has a pH of from 8 to 11.5, in particular 9 to 11.

In a further embodiment of compositions according to the invention for automatic dishwashing, 20 to 60% by weight of water-soluble organic builders, in particular alkali metal citrate, 3 to 20% by weight of alkali metal carbonate and 3 to 40% by weight of alkali metal disilicate are present.

In order to effect silver corrosion protection, silver corrosion inhibitors can be used in dishwashing compositions according to the invention. Preferred silver corrosion protectants are organic sulfides, such as cystine and cysteine, di- or trihydric phenols, optionally alkyl- or aryl-substituted triazoles, such as benzotriazole, isocyanuric acid, titanium, zirconium, hafnium, molybdenum, vanadium or cerium salts and/or complexes, and salts and/or complexes of the metals present in the complexes suitable according to the invention, with ligands other than those given in formula (I).

If the compositions foam excessively upon use, up to 6% by weight, preferably about 0.5 to 4% by weight, of a foam-regulating compound, preferably from the group consisting of silicones, paraffins, paraffin/alcohol combinations, hydrophobicized silicas, bisfatty acid amides and mixtures thereof and other further known commercially available foam inhibitors, can also be added. Preferably, the foam inhibitors, in particular silicone- and/or paraffin-containing foam inhibitors, are bonded to a granular water-soluble or -dispersible carrier substance. In this connection, particular preference is given to mixtures of paraffins and bistearylethylenediamide. Other possible ingredients in the compositions according to the invention are, for example, perfume oils.

The organic solvents which can be used in the compositions according to the invention, particularly if they are in liquid or paste form, include alcohols having 1 to 4 carbon atoms, in particular methanol, ethanol, isopropanol and tert-butanol, diols having 2 to 4 carbon atoms, in particular ethylene glycol and propylene glycol, and mixtures thereof and the ethers derivable from said classes of compound. Such water-miscible solvents are present in the cleaning compositions according to the invention in amounts of preferably at most 20% by weight, in particular from 1 to 15% by weight.

To set a desired pH which does not arise by itself as a result of mixing the other components, the compositions according to the invention can comprise system- and environment-compatible acids, in particular citric acid, acetic acid, tartaric acid, malic acid, lactic acid, glycolic acid, succinic acid, glutaric acid and/or adipic acid and also mineral acids, in particular sulfuric acid or alkali metal hydrogensulfates, or bases, in particular ammonium or alkali metal hydroxides. Such pH regulators are present in the compositions according to the invention in amounts of preferably at most 10% by weight, in particular from 0.5 to 6% by weight.

The compositions according to the invention are preferably preparations in the form of powders, granules or tablets, which can be prepared in a manner known per se, for example by mixing, granulation, roll compaction and/or spray-drying the thermally stable components and mixing in the more sensitive components, including, in particular, enzymes, bleaches and the bleach catalyst. Compositions according to the invention in the form of aqueous solutions or solutions comprising other customary solvents are particularly advantageously prepared by simply mixing the ingredients, which can be added without a diluent or as a solution to an automatic mixer.

To prepare particulate compositions with increased bulk density, in particular in the range from 650 g/l to 950 g/l, a process known from European patent EP 0 486 592 and having an extrusion step is preferred. A further preferred preparation using a granulation process is described in European patent EP 0 642 576. The preparation of compositions according to the invention in the form of non-dusting, storage-stable flowable powders and/or granules with high bulk densities in the range from 800 to 1 000 g/l can also be carried out by, in a first process stage, mixing the builder components with at least some of the liquid mixture components, with an increase in bulk density of this premix, and then, if desired after intermediate drying, combining the other constituents of the composition, including the bleach catalyst, with the premix obtained in this way.

To prepare compositions according to the invention in tablet form, preference is given to a procedure which involves mixing all of the constituents together in a mixer and compressing the mixture using conventional tableting presses, for example eccentric presses or rotary presses, using pressing forces in the range from 20 to 150 MPa. This thus gives without problems tablets which are resistant to breakage but which nevertheless dissolve sufficiently rapidly under use conditions and have flexural strengths of normally more than 150 N. A tablet prepared in this way preferably has a weight of from 1 to 40 g, in particular from 5 to 30 g, for a diameter of 3 to 40 mm, preferably from 5 to 35 mm.

In liquid or pasty applications, the complexes according to the invention are preferably used as aqueous solution or in microencapsulated form. If they are used for the purposes of utilizing atmospheric oxygen (aerial bleaching), it is possible to dispense with the use of peroxo compounds. However, should they be used in combination with a peroxide compound, e.g. hydrogen peroxide, the use of a multichamber container is advisable.

WORKING EXAMPLES

Example 1

Catalyst 1: (Diethyl-cyclam)$_2$Mn$_2$(DHBQ)(PF$_6$)$_2$ a.) Synthesis of 1,8-diethyl-1,4,8,11-tetraazacyclotetradecane manganese(II) dichloride 12.6 g (0.1 mol) of manganese(II) chloride were dissolved in 100 ml of DMAC. The solution was admixed with 25.6 g (0.1 mol) of 1,8-diethyl-1,4,8,11-tetraazacyclotetradecane. The reaction mixture was heated at 100° C. for 5 hours. The resulting suspension was then cooled to room temperature, and the resulting solid was filtered off, washed with 50 ml of DMAC and then dried in vacuo at a temperature of 80° C. This gave 37.1 g of the pale grey complex, which corresponds to a yield of 97.0%.

Analytical Data:

Elemental analysis for $C_{14}H_{32}N_4Cl_2Mn$ (382.2 g/mol):
calculated:
C, 43.9%; H, 8.4%; N, 14.6%; Cl, 18.6%; Mn, 14.6%.
found:
C, 44.1%; H, 8.8%; N, 14.6%; Cl, 18.7%; Mn, 13.7%.

b.) Reaction of 1,8-diethyl-1,4,8,11-tetraazacyclotetradecane manganese(II) chloride with 2,5-dihydroxy-1,4-benzoquinone to give (diethyl-cyclam)$_2$Mn$_2$(DHBQ)(PF$_6$)$_2$

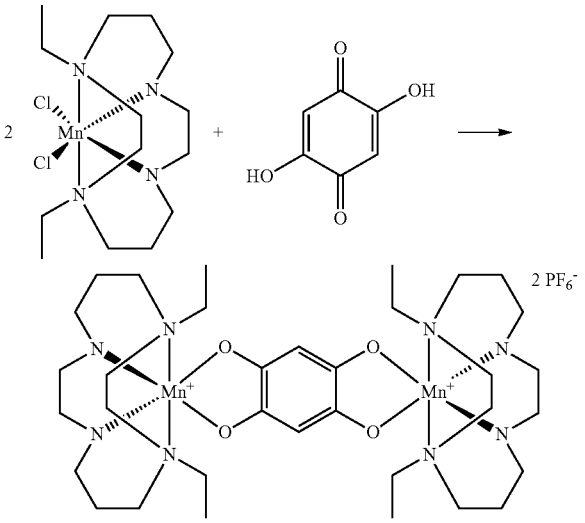

38.2 g (=100 mmol) of 1,8-diethyl-1,4,8,11-tetraazacyclotetradecane manganese(II) dichloride were suspended in 2000 ml of methanol, 7 g (=50 mmol) of 2,5-dihydroxy-1,4-benzoquinone (DHBQ) were added and then the mixture was admixed with 4 g (=100 mmol) of NaOH prills. The dark brown solution was heated at boiling for a period of 30 min and then, for the precipitation, a solution of 60 g of $KPF_6$ in 1000 ml of water was added. The solution was stored for several days in a refrigerator for the purposes of crystallization. The preparation was filtered off with suction and washed with water.

Yield: 38.2 g.

The product was dissolved in 1400 ml of methylene chloride, the manganese dioxide was filtered off and the filtrate was concentrated on a rotary evaporator and then recrystallized from 500 ml of MeOH.

Yield: 28.1 g (corresponding to 54% of theory) of dark violet crystals.

Elemental Analysis:

| | | | | | | | | |
|---|---|---|---|---|---|---|---|---|
| calculated: | C | 38.9%, | H | 6.3% | N | 10.7% | Mn | 10.5% |
| found: | C | 38.8%, | H | 6.6% | N | 10.3% | Mn | 10.7% |

IR (KBr): 1537, 825 $cm^{-1}$

UV (methanol): 326, 498 nm

Example 2

Catalyst 2: $(Dimethyl\text{-}cyclam)_2Mn_2(DHBQ)(PF_6)_2$

The procedure is analogous to Example 1 and firstly 1,8-dimethyl-1,4,8,11-tetraazacyclotetradecane and manganese dichloride are used to prepare 1,8-dimethyl-1,4,8,11-tetraazacyclotetradecanemanganese(II) dichloride. This is then admixed with 2,5-dihydroxy-1,4-benzoquinone (DHBQ) and sodium hydroxide solution and precipitated with $KPF_6$. It is taken up in methyl chloride, the manganese dioxide formed is filtered off and the concentrate is recrystallized from methanol.

Yield: 62% of blue-violet fine crystals.

Example 3

Catalyst 3: $(CHT)_2Mn_2(DHBQ)Cl_2.H_2O$

Catalyst 3 was prepared analogously to A. Die et al., "Tetraoxolene Radical Stabilization by Interaction with Transition-Metal Ions", Inorg. Chem., 30 (1991), 2590 from d,l-5,7,7,12,14,14-hexamethyl-1,4,8,11-tetraazacyclotetradecane (CHT), manganese dichloride, 2,5-dihydroxy-1,4-benzoquinone (DHBQ) and $KPF_6$.

Yield after recrystallization: 65%.

Example 4

Catalyst 4: $(Diethyl\text{-}Bcyclam)_2Mn_2(DHBQ)(PF_6)_2$

To produce 5,12-diethyl-1,5,8,12-tetraazabicyclo[6.6.2]hexadecane (diethyl-Bcyclam), the procedure was as per WO 1998/039 098, except the quaternization was carried out with diethyl sulfate instead of methyl iodide. The ligand was then reacted with manganese dichloride in dimethylacetamide to give (diethyl-Bcyclam)$MnCl_2$. In a further synthesis step, as in example 1b.), 2 molecules of (diethyl-Bcyclam)$MnCl_2$ are converted to the tetraoxolene complex by reaction with 2,5-dihydroxybenzoquinone in the presence of sodium hydroxide solution and said complex is precipitated by adding $KPF_6$.

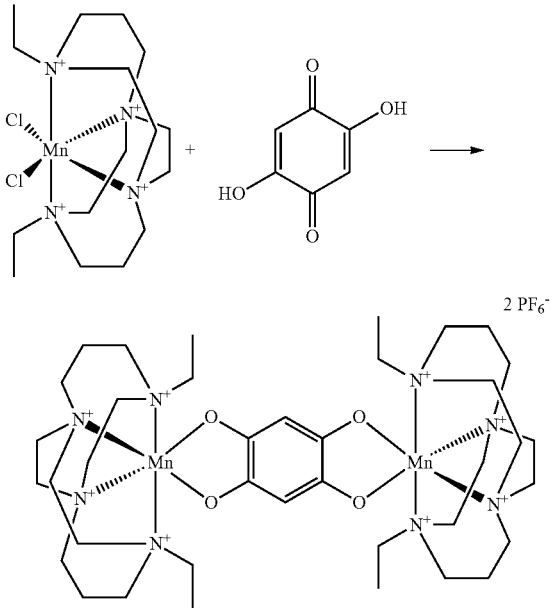

Proceeding from 20.4 g (=50 mmol) of (diethyl-Bcyclam) $MnCl_2$, 24.5 g (corresponding to 89%) of crude product are obtained, which is purified by means of methylene chloride and methanol/acetone.

Yield: 22.8 g (corresponding to 83% of theory) of deep-violet microcrystals.

Elemental Analysis:

| | | | | | | | | |
|---|---|---|---|---|---|---|---|---|
| calculated: | C | 41.4%, | H | 6.4% | N | 10.2% | Mn | 9.9% |
| found: | C | 44.1%, | H | 6.9% | N | 9.2% | Mn | 9.4% |

IR (KBr): 1536, 830 $cm^{-1}$

UV (methanol): 330, 498 nm

Example 5

Bleaching Performance of Catalyst 1 (Cat 1) and Catalyst 4 (Cat 4) in the Presence of Peroxides The bleach-boosting performance of the compounds Cat 1 and Cat 4 according to the invention was tested relative to sodium percarbonate. For this purpose, 10 mg/l of Cat 1 or Cat 4 were dissolved in a wash liquor, prepared by dissolving 2 g/l of a bleach-free basic detergent (IEC-A, WFK, Krefeld). Following the addition of 0.5 g/l of sodium percarbonate SPC (Degussa), the washing experiments were carried out in a Linitest apparatus (Heraeus) at a temperature of 40° C. The washing time was 30 min, water hardness 18 German hardness. The bleaching test fabric used was tea stains on cotton (BC-1, WFK, Krefeld), grass on cotton (CS-8, CFT) and curry on cotton (BC-34, CFT). As bleaching result, the difference in reflectance, measured using an Elrepho apparatus, after washing was evaluated relative to the unwashed fabric. As a comparative experiment (C1), the bleaching performance of SPC without the addition of catalyst was ascertained.

Results of washing at 40° C.

| Compound | Difference in reflectance (delta R %) | | |
|---|---|---|---|
| | BC-1 | CS-8 | BC-34 |
| Cat 1 | 6.9 | 18.8 | 29.7 |
| Cat 4 | 6.1 | 19.6 | 29.6 |
| SPC (C1) | 4.5 | 16.7 | 16.6 |

It can be seen that the compounds according to the invention (Cat 1 and Cat 4) can achieve a significantly better bleaching effect. Essentially the same results were obtained when the sodium percarbonate was replaced with sodium perborate.

Example 6

Bleaching in the Presence of Atmospheric Oxygen

The bleaching performance of the compounds according to the invention Cat 1 and Cat 4 was tested without adding peroxides. For this purpose, 10 mg/l of Cat 1 or Cat 4 were dissolved in a wash liquor, prepared by dissolving 2 g/l of a bleach-free basic washing composition (IEC-A, WFK, Krefeld). The washing experiments were carried out in a Linitest apparatus (Heraeus) at a temperature of 40° C. The washing time was 30 min, water hardness 18 German hardness. After the washing, the fabric was dried and ironed. The bleaching test fabric used was curry on cotton (BC-34, CFT), ketchup on cotton (10-T, WFK, Krefeld), tomato on cotton (CS-20, CFT). As bleaching result, the difference in reflectance, measured using an Elrepho apparatus, after washing was evaluated compared to the unwashed fabric. As a comparative experiment (C1), the washing composition was used without the addition of complex.

Results of washing at 40° C.

| Compound | Difference in reflectance (delta R %) | | |
|---|---|---|---|
| | BC-34 | 10-T | CS-20 |
| Cat 1 | 20.3 | 23.9 | 18.5 |
| Cat 4 | 19.7 | 23.5 | 29.9 |
| IEC-A (C1) | 16.8 | 19.0 | 18.3 |

It can likewise be seen from the higher values that the compounds according to the invention Cat 1 and Cat 4 facilitate a significantly better bleaching effect even without the addition of peroxides.

The invention claimed is:

1. A washing or cleaning composition for the washing of textiles or for hard surfaces, and for solutions for bleaching colored soilings, comprising at least one bleach catalyst, wherein the at least one bleach catalyst comprises at least one transition metal complex, wherein the transition metal complex comprises a tetraoxolene unit, and at least two macrocyclic, N-containing ligands, wherein the transition metal complex is according to the chemical formula (I)

$$[(L)M(Y)M(L)]X_m \quad (I)$$

where

M is a metal atom selected from the group consisting of Mn and Fe,

L is a ligand of the formula (II) or (III)

(II)

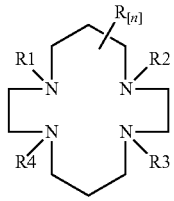

(III)

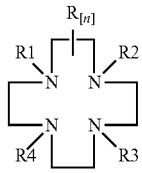

in which

R is a hydrogen or an alkyl having 1 to 8 carbon atoms,

R1, R2, R3 and R4 are identical or different and are a hydrogen, an alkyl having 1 to 8 carbon atoms, a nitrogen-bridging alkylene unit having 2 to 4 carbon atoms or an alkaryl having 6 to 16 carbon atoms, n is an integer from 0 to 6, Y is a group of the formula (IV)

(IV)

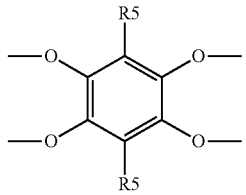

in which

R5 are identical or different and are a hydrogen, an alkyl having 1 to 4 carbon atoms, Cl or Br X is a neutral or anion ligand selected from the group consisting of $CH_3CN$, chloride, bromide, nitrate, perchlorate, sulfate, citrate, hexafluorophosphate, trifluoromethanesulfonate, tetrafluoroborate, tetraphenylborate, and anions of organic acids with $C_1$-$C_{22}$ carbon atoms, and $H_2O$, and m is a number from 0 to 4; and bleach activators which release peroxocarboxylic acids under perhydrolysis conditions.

2. The washing or cleaning composition as claimed in claim 1, wherein the composition comprises the transition metal complexes in an amount of from 0.0025 to 1% by weight.

3. The washing or cleaning composition as claimed in claim 1, wherein the bleach activators are present in an amount of from 0.1 to 20% by weight, based on the total weight of the washing or cleaning composition.

4. A washing or cleaning composition for the washing of textiles or for hard surfaces, and for solutions for bleaching colored soilings, comprising at least one bleach catalyst, wherein the at least one bleach catalyst comprises at least one transition metal complex, wherein the transition metal complex comprises a tetraoxolene unit, and at least two macrocyclic, N-containing ligands, wherein the transition metal complex is according to the chemical formula (I)

$$[(L)M(Y)M(L)]X_m \quad (I)$$

where

M is a metal atom selected from the group consisting of Mn and Fe,

L is a ligand of the formula (II) or (III)

(II)

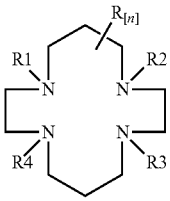

(III)

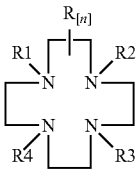

in which

R is a hydrogen or an alkyl having 1 to 8 carbon atoms,

R1, R2, R3 and R4 are identical or different and are a hydrogen, an alkyl having 1 to 8 carbon atoms, a nitrogen-bridging alkylene unit having 2 to 4 carbon atoms or an alkaryl having 6 to 16 carbon atoms, n is an integer from 0 to 6, Y is a group of the formula (IV)

(IV)

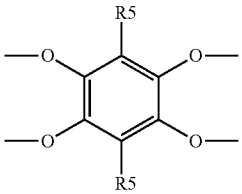

in which

R5 are identical or different and are a hydrogen, an alkyl having 1 to 4 carbon atoms, Cl or Br, X is a neutral or anion ligand selected from the group consisting of $CH_3CN$, chloride, bromide, nitrate, perchlorate, sulfate, citrate, hexafluorophosphate, trifluoromethanesulfonate, tetrafluoroborate, tetraphenylborate, and anions of organic acids with $C_1$-$C_{22}$ carbon atoms, and $H_2O$, and m is a number from 0 to 4; and open-chain or cyclic nitrile quats or benzoylcaprolactam or acetylcaprolactam.

5. The washing or cleaning composition as claimed in claim 1, wherein the composition is in the form of granules, in the form of a pulverulent or tablet-shaped solid, as a homogeneous solution, or as a suspension.

6. A washing or cleaning composition for the washing of textiles or for hard surfaces, and for solutions for bleaching colored soilings, comprising at least one bleach catalyst, wherein the at least one bleach catalyst comprises at least one transition metal complex, wherein the transition metal complex comprises a tetraoxolene unit, and at least two macrocyclic, N-containing ligands, wherein the transition metal complex is according to the chemical formula (I)

$$[(L)M(Y)M(L)]X_m \quad (I)$$

where

M is a metal atom selected from the group consisting of Mn and Fe,

L is a ligand of the formula (II) or (III)

(II)

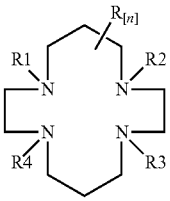

(III)

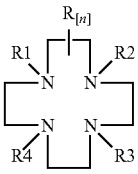

in which

R is a hydrogen or an alkyl having 1 to 8 carbon atoms,

R1, R2, R3 and R4 are identical or different and are a hydrogen, an alkyl having 1 to 8 carbon atoms, a nitrogen-bridging alkylene unit having 2 to 4 carbon atoms or an alkaryl having 6 to 16 carbon atoms, n is an integer from 0 to 6, Y is a group of the formula (IV)

(IV)

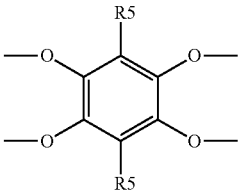

in which

R5 are identical or different and are a hydrogen, an alkyl having 1 to 4 carbon atoms, Cl or Br, X is a neutral or anion ligand selected from the group consisting of $CH_3CN$, chloride, bromide, nitrate, perchlorate, sulfate, citrate, hexafluorophosphate, trifluoromethanesulfonate, tetrafluoroborate, tetraphenylborate, and anions of organic acids with $C_1$-$C_{22}$ carbon atoms, and $H_2O$, and m is a number from 0 to 4; from 5 to 25% by weight, based on the total weight of the washing or cleaning composition, of a peroxygen compound; and a peroxygen activator or an organic peracid.

7. A washing or cleaning composition for the washing of textiles or for hard surfaces, and for solutions for bleaching colored soilings, comprising at least one bleach catalyst, wherein the at least one bleach catalyst comprises at least one transition metal complex, wherein the transition metal complex comprises a tetraoxolene unit, and at least two macrocyclic, N-containing ligands, wherein the transition metal complex is according to the chemical formula (I)

$$[(L)M(Y)M(L)]X_m \quad (I)$$

where

M is a metal atom selected from the group consisting of Mn and Fe,

L is a ligand of the formula (II) or (III)

(II)

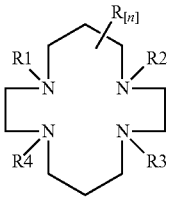

(III)

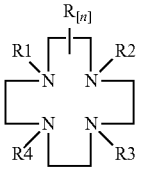

in which

R is a hydrogen or an alkyl having 1 to 8 carbon atoms,

R1, R2, R3 and R4 are identical or different and are a hydrogen, an alkyl having 1 to 8 carbon atoms, a nitrogen-bridging alkylene unit having 2 to 4 carbon atoms or an alkaryl having 6 to 16 carbon atoms, n is an integer from 0 to 6, Y is a group of the formula (IV)

(IV)

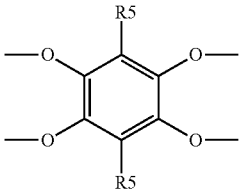

in which

R5 are identical or different and are a hydrogen, an alkyl having 1 to 4 carbon atoms, Cl or Br, X is a neutral or anion ligand selected from the group consisting of $CH_3CN$, chloride, bromide, nitrate, perchlorate, sulfate, citrate, hexafluorophosphate, trifluoromethanesulfonate, tetrafluoroborate, tetraphenylborate, and anions of organic acids with $C_1$-$C_{22}$ carbon atoms, and $H_2O$, and m is a number from 0 to 4; and a bleach activator selected from the group consisting of: polyacylated alkylenediamines, tetraacetylethylenediamine (TAED), acylated glycolurils, tetraacetylglycoluril (TAGU), acylated triazine derivatives, 1,5-diacetyl-2,4-dioxohexahydro-1,3,5-triazine (DADHT), acylated phenylsulfonates, nonanoyl, isononanoyl or lauroyloxybenzenesulfonate (NOBS, ISONOBS and LOBS) or amido derivatives thereof, acylated hydroxycarboxylic acids, acetylsalicylic acid, nonanoyloxybenzoic acid (NOBA), decanoyloxybenzoic acid (DOBA), acylated polyhydric alcohols, triacetin, ethylene glycol diacetate, 2,5-diacetoxy-2,5-dihydrofuran, acetylated sorbitol, mannitol, acylated sugar derivatives, pentaacetyl glucose (PAG), pentaacetylfructose, tetraacetylxylose, octaacetyllactose, acetylated optionally N-alkylated glucamine and gluconolactone.

8. The washing or cleaning composition as claimed in claim 4, wherein the composition comprises the transition metal complexes in an amount of from 0.0025 to 1% by weight.

9. The washing or cleaning composition as claimed in claim 6, wherein the composition comprises the transition metal complexes in an amount of from 0.0025 to 1% by weight.

10. The washing or cleaning composition as claimed in claim 7, wherein the composition comprises the transition metal complexes in an amount of from 0.0025 to 1% by weight.

11. The washing or cleaning composition as claimed in claim 4, wherein the composition is in the form of granules, in the form of a pulverulent or tablet-shaped solid, as a homogeneous solution, or as a suspension.

12. The washing or cleaning composition as claimed in claim 6, wherein the composition is in the form of granules, in the form of a pulverulent or tablet-shaped solid, as a homogeneous solution, or as a suspension.

13. The washing or cleaning composition as claimed in claim 7, wherein the composition is in the form of granules, in the form of a pulverulent or tablet-shaped solid, as a homogeneous solution, or as a suspension.

14. The washing or cleaning composition as claimed in claim 1, wherein the composition further comprises at least one of a builder substance, a surface-active surfactant, a peroxygen compound, an additional peroxygen activator, an organic peracid, a water-miscible organic solvent, a sequestrant, an enzyme, a special additive having a color- or fiber-preserving effect, electrolytes pH regulators, silver corrosion inhibitors, foam regulators, dyes, or fragrances.

15. The washing or cleaning composition as claimed in claim 4, wherein the composition further comprises at least one of a builder substance, a surface-active surfactant, a peroxygen compound, an additional peroxygen activator, an organic peracid, a water-miscible organic solvent, a sequestrant, an enzyme, a special additive having a color- or fiber-preserving effect, electrolytes pH regulators, silver corrosion inhibitors, foam regulators, dyes, or fragrances.

16. The washing or cleaning composition as claimed in claim 6, wherein the composition further comprises at least one of a builder substance, a surface-active surfactant, a water-miscible organic solvent, a sequestrant, an enzyme, a special additive having a color- or fiber-preserving effect, electrolytes pH regulators, silver corrosion inhibitors, foam regulators, dyes, or fragrances.

17. The washing or cleaning composition as claimed in claim 7, wherein the composition further comprises at least one of a builder substance, a surface-active surfactant, a peroxygen compound, an additional peroxygen activator, an organic peracid, a water-miscible organic solvent, a sequestrant, an enzyme, a special additive having a color- or fiber-preserving effect, electrolytes pH regulators, silver corrosion inhibitors, foam regulators, dyes, or fragrances.

* * * * *